US011488759B2

(12) United States Patent
Kim et al.

(10) Patent No.: US 11,488,759 B2
(45) Date of Patent: Nov. 1, 2022

(54) TRANSFORMER IRON CORE

(71) Applicant: HYOSUNG HEAVY INDUSTRIES CORPORATION, Seoul (KR)

(72) Inventors: Do Jin Kim, Changwon-si (KR); Chul Jun Park, Busan (KR); Kyo Ho Lee, Gimhae-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 716 days.

(21) Appl. No.: 16/470,772

(22) PCT Filed: Dec. 4, 2017

(86) PCT No.: PCT/KR2017/014110
§ 371 (c)(1),
(2) Date: Jun. 18, 2019

(87) PCT Pub. No.: WO2018/117483
PCT Pub. Date: Jun. 28, 2018

(65) Prior Publication Data

US 2020/0090851 A1 Mar. 19, 2020

(30) Foreign Application Priority Data

Dec. 20, 2016 (KR) ..... 10-2016-0174247

(51) Int. Cl.
*H01F 27/24* (2006.01)
*H01F 27/245* (2006.01)
(Continued)

(52) U.S. Cl.
CPC ..... *H01F 27/245* (2013.01); *H01F 27/263* (2013.01); *H01F 41/0233* (2013.01)

(58) Field of Classification Search
CPC .. H01F 27/245; H01F 27/263; H01F 41/0233; H01F 3/02
See application file for complete search history.

(56) References Cited

U.S. PATENT DOCUMENTS 2,628,273 A * 2/1953 Somerville ..... H01F 27/245 29/609
3,559,136 A * 1/1971 Specht et al. ..... H01F 27/245 29/609
(Continued)

FOREIGN PATENT DOCUMENTS

JP 08069922 A * 3/1996
JP 11-111529 A 4/1999
(Continued)

*Primary Examiner* — Tuyen T Nguyen
(74) *Attorney, Agent, or Firm* — Novick, Kim & Lee PLLC; Jae Youn Kim

(57) ABSTRACT

The present invention relates to a transformer iron core. The present invention comprises: an upper yoke (50); a lower yoke (51) extending in parallel with the upper yoke (50); and an end leg (60) which is installed between the upper yoke (50) and the lower yoke (51), which extends perpendicularly to the longitudinal direction of the upper yoke (50) and the lower yoke (51), and which is coupled to the upper yoke (50) and to the lower yoke (51). The upper yoke (50) and the lower yoke (51) are made by laminating multiple yoke steel plates (50'). The end leg (60) is also made by laminating multiple leg steel plates (60'). The upper yoke (50) and the lower yoke (51) have leg coupling portions (52) on both ends thereof. The end leg (60) has yoke coupling portions (62) coupled to the leg coupling portions (52).

6 Claims, 7 Drawing Sheets

(51) Int. Cl.
*H01F 41/02* (2006.01)
*H01F 27/26* (2006.01)

(56) References Cited

U.S. PATENT DOCUMENTS 3,918,153 A * 11/1975 Burkhardt ..... H01F 27/245
29/609
4,482,880 A * 11/1984 Ohta ..... H01F 27/245
336/216

FOREIGN PATENT DOCUMENTS

| | | | | |
|---|---|---|---|---|
| JP | 2013080856 | A | * | 5/2013 |
| JP | 2014-078638 | A | | 5/2014 |
| KR | 20-0261541 | Y1 | | 1/2002 |
| KR | 10-1302830 | A | | 7/2013 |
| KR | 10-2016-0081493 | A | | 7/2016 |
| KR | 10-2016-0126344 | A | | 11/2016 |

* cited by examiner

TRANSFORMER IRON CORE

TECHNICAL FIELD

The present invention relates to an iron core of a transformer, and more particularly to an iron core of a transformer manufactured by stacking electric steel sheets, wherein the iron core functions as a path for a line of magnetic force.

BACKGROUND ART

A transformer is a conversion apparatus that changes the magnitudes of alternating-current voltage and current using an electromagnetic induction phenomenon. In general, the transformer is configured to have a structure in which a plurality of winding wires is wound around a common iron core. Electric power is input to one of the winding wires, and is output from the other winding wire.

An iron core used in the transformer described above has the construction shown in FIG. 1. An iron core of a general transformer includes an upper yoke 10, a lower yoke 20, and a leg 30.

The upper yoke 10 forms the upper part of the iron core, and is constituted by stacking a plurality of electric steel sheets. The upper yoke 10 is provided with a leg connection portion 11 for connection with the leg 30.

The lower yoke 20 forms the lower part of the iron core, is constituted by stacking a plurality of electric steel sheets, and is oriented parallel to the upper yoke 10. The lower yoke 20 is provided with a leg connection portion 21 for connection with the leg 30.

A plurality of legs 30 is provided and connected to the upper yoke 10 and to the lower yoke 20 in the state of being spaced apart from each other by a predetermined distance. The direction in which the legs 30 extend is perpendicular to the direction in which the upper yoke 10 and the lower yoke 20 extend. Each of the legs 30 is also constituted by stacking a plurality of electric steel sheets.

Meanwhile, at the portions of connection between the upper yoke 10 and the legs 30 and at the portions of connection between the lower yoke 20 and the legs 30, ends of the steel sheets constituting the yokes and ends of the steel sheets constituting the legs are alternately stacked, or the steel sheets of the yokes 10 and 20 and the legs 30 are sequentially placed so as to overlap in groups such that the steel sheets are coupled to each other, as disclosed in Korean Registered Patent No. 10-1302830.

In the case in which the portions at which the upper yoke 10 and the legs 30 are coupled to each other and the portions at which the lower yoke 20 and the legs 30 are coupled to each other are constructed as described above, the positions at which the steel sheets constituting the yokes and the steel sheets constituting the legs are joined to each other differ from each other between adjacent steel sheets that are stacked. However, according to this construction, as shown in FIG. 2, a protrusion 40 is formed at the outer corner of the portion at which a leg coupling portion 11 or 21 and a yoke coupling portion 31 are coupled to each other.

The protrusion 40 protrudes outwards from the iron core. In the case in which steel sheets are sequentially stacked one by one, gaps are generated between the protruding steel sheets. As a result, displacement due to a magnetostriction phenomenon occurs at the protrusion 40, whereby a large amount of vibration is generated.

Technical Problem

Therefore, the present invention has been made in view of the above problems, and it is an object of the present invention to prevent a portion of a steel sheet from protruding out of the portion at which a yoke and a leg are coupled to each other.

It is another object of the present invention to form a space along the outside of the portion at which the yoke and the leg are coupled to each other such that a coupling material is disposed in the space.

Technical Solution

In accordance with the present invention, the above and other objects can be accomplished by the provision of an iron core of a transformer, the iron core including an upper yoke provided at opposite ends thereof with leg coupling portions, the upper yoke being manufactured by stacking a plurality of yoke steel sheets, a lower yoke extending parallel to the upper yoke, the lower yoke being provided at opposite ends thereof with leg coupling portions, the lower yoke being manufactured by stacking a plurality of yoke steel sheets, end legs installed in a direction perpendicular to the direction in which the upper yoke and the lower yoke extend, one end of each of the end legs being coupled to a corresponding one of the leg coupling portions of the upper yoke and the other end of each of the end legs being coupled to a corresponding one of the leg coupling portions of the lower yoke, wherein the stacked yoke steel sheets and leg steel sheets overlap each other by a predetermined length at a first coupling end of each of the leg coupling portions and a second coupling end of a corresponding one of yoke coupling portions, and a space is formed between a first open end provided at each of the leg coupling portions and a second open end provided at a corresponding one of the yoke coupling portions.

Each of the yoke steel sheets may be provided at opposite ends thereof with first unit coupling ends, each of which may intersect, at an angle a, the direction in which the outer side of the yoke steel sheet extends, the angle a being an acute angle, and the angle defined between the extension line of each of the first unit open ends and the outer side of the yoke steel sheet may be greater than the angle a and less than 180 degrees.

Each of the leg steel sheets may be provided at opposite ends thereof with second unit coupling ends, each of which may intersect, at an angle b, the direction in which the outer side of the leg steel sheet extends, the angle b being an acute angle, and the angle defined between the extension line of each of the second unit open ends and the outer side of the leg steel sheet may be greater than the angle b and less than 180 degrees.

The yoke steel sheets and the leg steel sheets may be stacked such that the center lines of the yoke steel sheets and the leg steel sheets in the longitudinal direction thereof are aligned with each other, and may be configured such that the dimensions of the yoke steel sheets and the leg steel sheets in the longitudinal direction thereof are periodically changed.

The space formed between the first open end, provided at each of the leg coupling portions, and the second open end, provided at a corresponding one of the yoke coupling portions, may be filled with a coupling material.

The widths of the yoke steel sheets and the leg steel sheets may be changed depending on positions at which the yoke steel sheets and the leg steel sheets are stacked such that at least a portion of each of the upper yoke, the lower yoke, and the end legs is curved.

The yoke steel sheets and the leg steel sheets may periodically overlap each other by a predetermined length at the first coupling ends of the leg coupling portions and the second coupling ends of the yoke coupling portions.

Advantageous Effects

An iron core of a transformer according to the present invention has the following effects.

In the present invention, a leg coupling portion formed at a yoke is provided with a coupling end and an open end, and a yoke coupling portion formed at a leg is provided with a coupling end and an open end, which correspond respectively to the coupling end and the open end of the leg coupling portion. The coupling end of the yoke and the coupling end of the leg contact each other, and the open end of the yoke and the open end of the leg are spaced apart from each other by a predetermined distance such that a space is formed in the direction in which steel sheets are stacked. As a result, the space is formed, by the open ends, outside the portion at which the yoke and the leg are coupled to each other, whereby no protrusions are formed at the steel sheets. Consequently, it is possible to reduce the possibility of vibration being generated due to a magnetostriction phenomenon, whereby it is possible to minimize the generation of noise from the iron core of the transformer.

Also, in the present invention, the space is formed in the direction in which the steel sheets are stacked by the open ends, formed by removing some of the leg coupling portion and the yoke coupling portion, and the space is filled with a coupling material in order to fix the steel sheets. Consequently, the steel sheets are securely coupled to each other at the portion at which the yoke and the leg are coupled to each other, whereby the generation of noise is prevented and the durability of the iron core is improved.

BEST MODE

Figure 1:
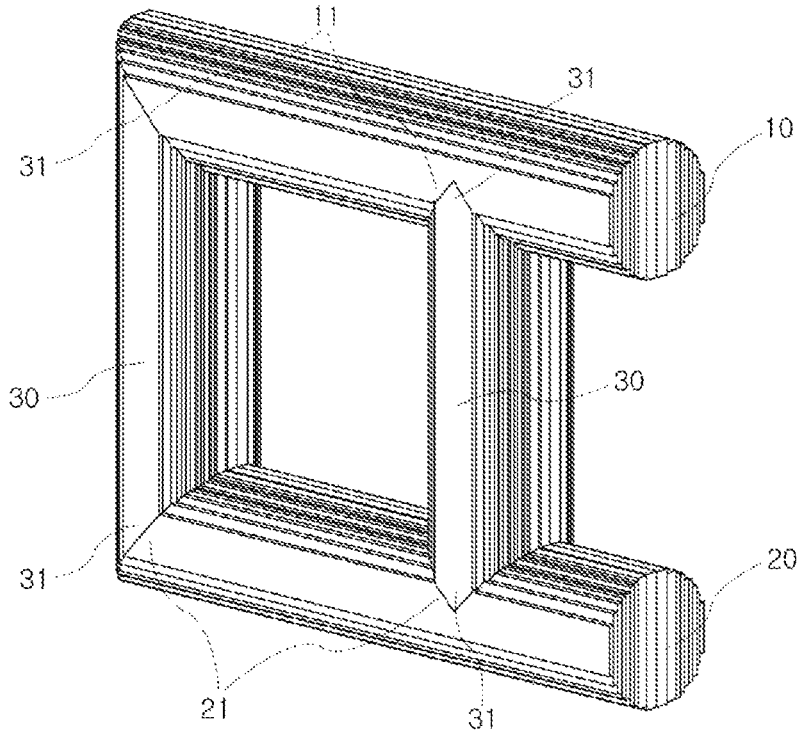
FIG. 1 PRIOR ART
FIG. 1 is a sectional perspective view showing the structure of an iron core of a general transformer.
Figure 2:
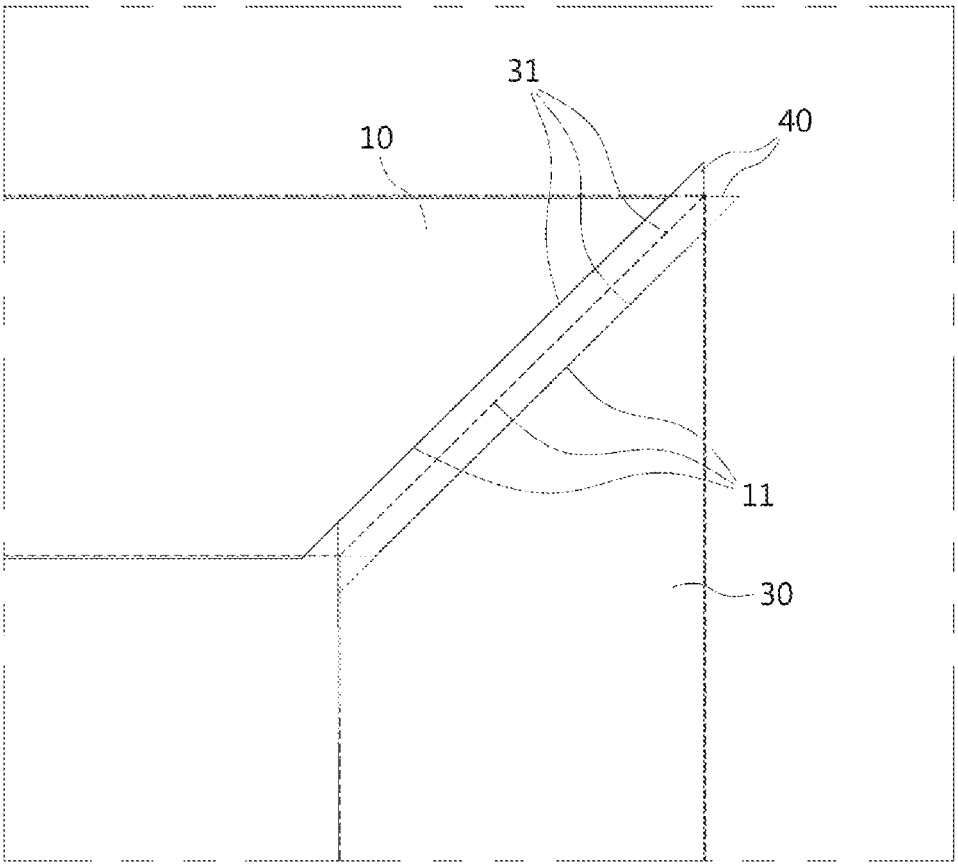
FIG. 2 PRIOR ART
FIG. 2 is a front view showing that a protrusion is formed at an iron core of a conventional transformer.

Hereinafter, some embodiments of the present invention will be described with reference to the illustrative drawings. In the drawings, the same elements are denoted by the same reference numerals even though they are depicted in different drawings. Also, in describing the embodiments of the present invention, a detailed description of known functions and configurations incorporated herein will be omitted when it is determined that inclusion of the same would impede understanding of the embodiments of the present invention.

Also, in describing the components of the embodiments of the present invention, terms such as "first," "second," "A," "B," "(a)," and "(b)" may be used. These terms are used only for the purpose of distinguishing one constituent from another, and the terms do not limit the nature, order or sequence of the components. When one component is said to be "connected," "coupled," or "linked" to another, it should be understood that this means that the one component may be directly connected or linked to the other one, or that yet another component may be interposed between the components.

As shown in the drawings, an iron core according to an embodiment of the present invention includes an upper yoke 50 and a lower yoke 51, which are located parallel to each other, and an end leg 60, which extends so as to be perpendicular to the direction in which the upper yoke 50 and the lower yoke 51 extend and opposite ends of which are connected to the upper yoke 50 and to the lower yoke 51. In the embodiment shown, the iron core is configured to have an approximate quadrangular shape, when viewed in a front view, and two end legs 60 and one middle leg 61 connect the upper yoke 50 and the lower yoke 51 to each other. For reference, in the iron core according to the present invention, the length of the upper yoke 50 is about several meters.

Each of the upper yoke 50 and the lower yoke 51 is manufactured by stacking a plurality of yoke steel sheets 50'. Each of the yoke steel sheets 50' is a thin metal sheet having a thickness of 1 mm or less, a width of about several tens of centimeters, and a length of about several meters. Several tens or several hundreds of yoke steel sheets 50' are stacked to form the upper yoke 50 or the lower yoke 51. The yoke steel sheets 50' may have different widths depending on the positions at which the yoke steel sheets are stacked. That is, the cross section of the upper yoke 50 or the lower yoke 51 when cut in the crosswise direction may have an approximately circular shape, a semicircular shape, or a polygonal shape that is approximately circular. These yoke steel sheets 50' are stacked in tight contact therebetween without using an adhesive therebetween and even without air therebetween.

A tape or a belt is wound around the outer surface of each of the upper yoke 50 and the lower yoke 51 so as to fix each of the upper yoke and the lower yoke in the state in which the yoke steel sheets 50' are stacked. The reason for this is that, in the case in which fastening members are provided through the upper yoke 50 or the lower yoke 51, the flow of magnetic flux is disturbed.

Opposite ends of each of the upper yoke 50 and the lower yoke 51 are inclined to form leg coupling portions 52. The reason for this is that the end leg 60 is coupled to the leg coupling portions 52. Each of the leg coupling portions 52 includes a first coupling end 54 and a first open end 56. The first coupling end 54 is the portion that is coupled to a second coupling portion 64 of the end leg 60, a description of which will follow, and the first open end 56 is the portion that is adjacent to a second open end 66 of the end leg 60, a space 70 being defined therebetween.

In this embodiment, a leg middle coupling portion 58 is provided in the approximate middle of each of the upper yoke 50 and the lower yoke 51. The leg middle coupling portion 58 is the portion that is coupled to a yoke coupling portion 68 of the middle leg 61, which is one of the legs 60 and 61. In the case in which a plurality of middle legs 61 is provided, leg middle coupling portion 58 are also provided at a plurality of positions.

Figure 4:
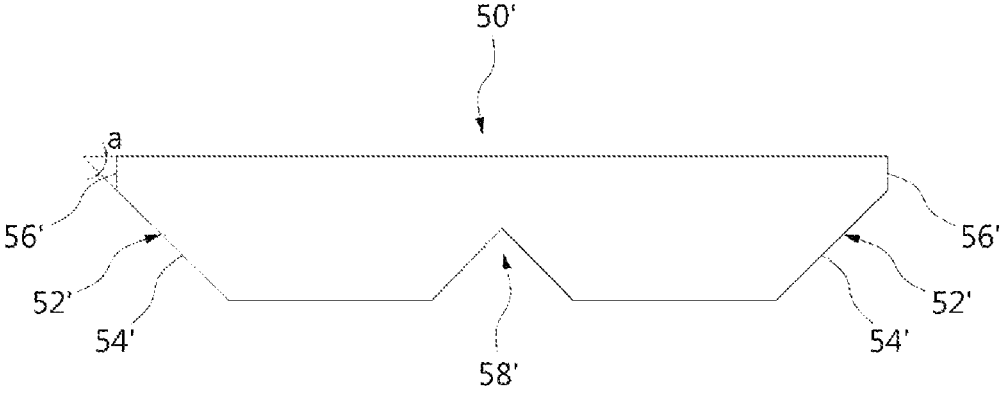
FIG. 4 is a front view showing one of electric steel sheets used in an upper yoke constituting the embodiment of the present invention.

Meanwhile, the upper yoke 50 or the lower yoke 51 is manufactured by stacking the yoke steel sheets 50', one of which is shown in FIG. 4. The shape of each of the yoke steel sheets 50' constituting each of the upper yoke 50 and the lower yoke 51 is as shown in FIG. 4. Each of the yoke steel sheets 50' is provided at opposite ends thereof with unit leg coupling portions 52', which constitute the leg coupling portions 52. Each of the unit leg coupling portions 52' also includes a first unit coupling end 54' and a first unit open end 56'. The first unit coupling end 54' is formed so as to be inclined relative to the longitudinal direction by a predetermined angle. That is, the first unit coupling end is formed so as to be inclined relative to the outer side of the yoke steel sheet 50' by an angle a, as shown in FIG. 4. The angle a is an acute angle. Most preferably, however, the angle is about 45 degrees. The angle between the extension line of the first unit open end 56' and the outer side of the yoke steel sheet 50' is greater than the angle a and less than 180 degrees. Preferably, however, the angle between the extension line of the first unit open end 56' and the outer side of the yoke steel sheet 50' is about 90 degrees. A first unit leg middle coupling portions 58' is provided at a position corresponding to the leg middle coupling portion 58 of each of each of the upper yoke 50 and the lower yoke 51.

The yoke steel sheets 50' do not all have the same shape and the same dimensions. The yoke steel sheets 50' may have different widths depending on the positions at which the yoke steel sheets are stacked. As a result, the cross-sectional shape of the upper yoke 50 or the lower yoke 51 is approximately circular. The dimensions and shape of the yoke steel sheets 50' in the longitudinal direction thereof are changed depending on the extent to which the yoke steel sheets 50' and leg steel sheets 60', which are stacked at upper and lower positions, overlap at the leg coupling portion 52 and the yoke coupling portion 62. That is, the kind of the yoke steel sheets 50' is changed depending on the cycle in the extent of overlapping between the yoke steel sheets 50' and the leg steel sheets 60'.

The reason that the extent of overlapping between the yoke steel sheets 50' and the leg steel sheets 60' is changed, as described above, i.e. the reason that the position at which the first unit coupling end 54' of each of the yoke steel sheets 50' and a second unit coupling end 64' of a corresponding one of the leg steel sheets 60' are joined to each other is changed between the steel sheets 50' and 60', which are stacked at upper and lower positions, (see FIG. 7) is that the flow of magnetic flux is smoothly achieved while coupling at the yoke coupling portions 62 and the leg coupling portions 52 is securely maintained. For reference, content related thereto is sufficiently illustrated in FIGS. 3 and 4 of Korean Registered Patent No. 10-1302830.

Figure 5:
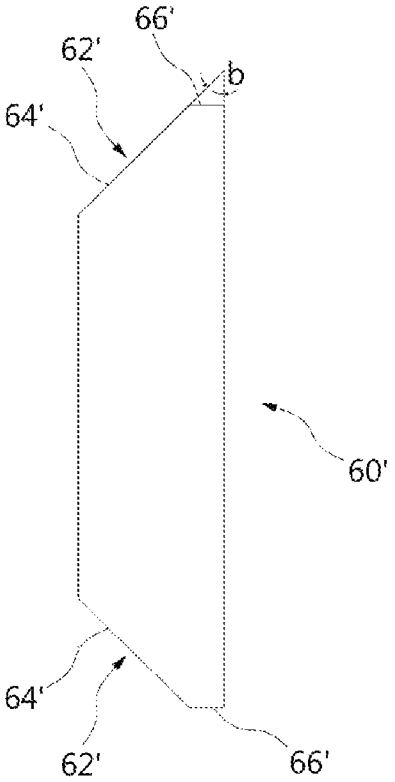
FIG. 5 is a front view showing one of electric steel sheets used in a leg constituting the embodiment of the present invention.

Next, a leg steel sheet 60' constituting the end leg 60 is shown in FIG. 5. Unit yoke coupling portions 62' are formed at opposite ends of the leg steel sheet 60'. In the case in which a plurality of leg steel sheets 60' is stacked, the unit yoke coupling portions 62' constitute the yoke coupling portion 62. Each of the unit yoke coupling portions 62' includes a second unit coupling end 64' and a second unit open end 66'. The second unit coupling end 64' is an inclined part of the unit yoke coupling portion 62' of the leg steel sheet 60', and the second unit open end 66' is the part of the unit yoke coupling portion that is formed so as to be perpendicular to the longitudinal direction of the leg steel sheet 60'. The second unit coupling end 64' of the unit yoke coupling portion 62' is formed so as to be inclined relative to the longitudinal direction of the leg steel sheet 60' by a predetermined angle. That is, the second unit coupling end is formed so as to be inclined relative to the outer side of the leg steel sheet 60' by an angle b. The angle b is an acute angle. Most preferably, however, the angle is about 45 degrees. The angle between the extension line of the second unit open end 66' and the outer side of the leg steel sheet 60' is greater than the angle b and less than 180 degrees. Preferably, however, the angle between the extension line of the second unit open end 66' and the outer side of the leg steel sheet 60' is about 90 degrees.

Meanwhile, middle yoke coupling portions 68 are formed at opposite ends of the middle leg 61 so as to be aligned with the leg middle coupling portions 58 of the upper yoke 50 and the lower yoke 51. At the middle yoke coupling portions 68 and the leg middle coupling portions 58, the yoke steel sheets 50' and middle leg steel sheets 61', which are stacked, periodically overlap each other.

Figure 6:
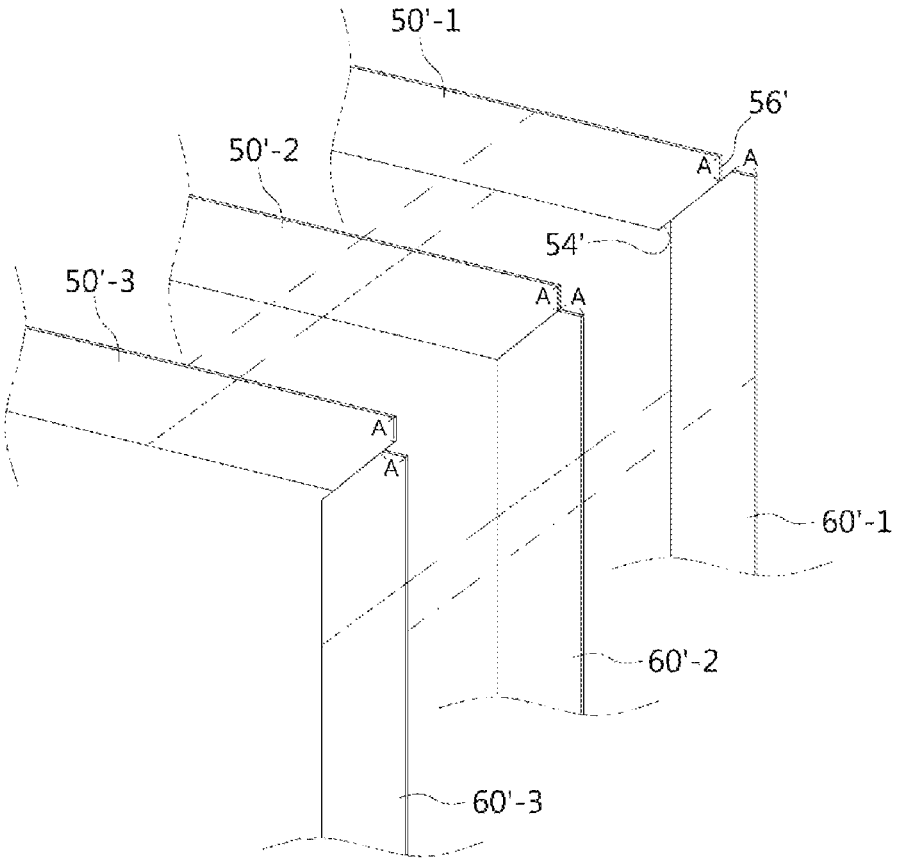
FIG. 6 is an exploded perspective view showing that pairs of yoke steel sheets and leg steel sheets are stacked in the state of being in contact with each other in the embodiment of the present invention.
Figure 7:
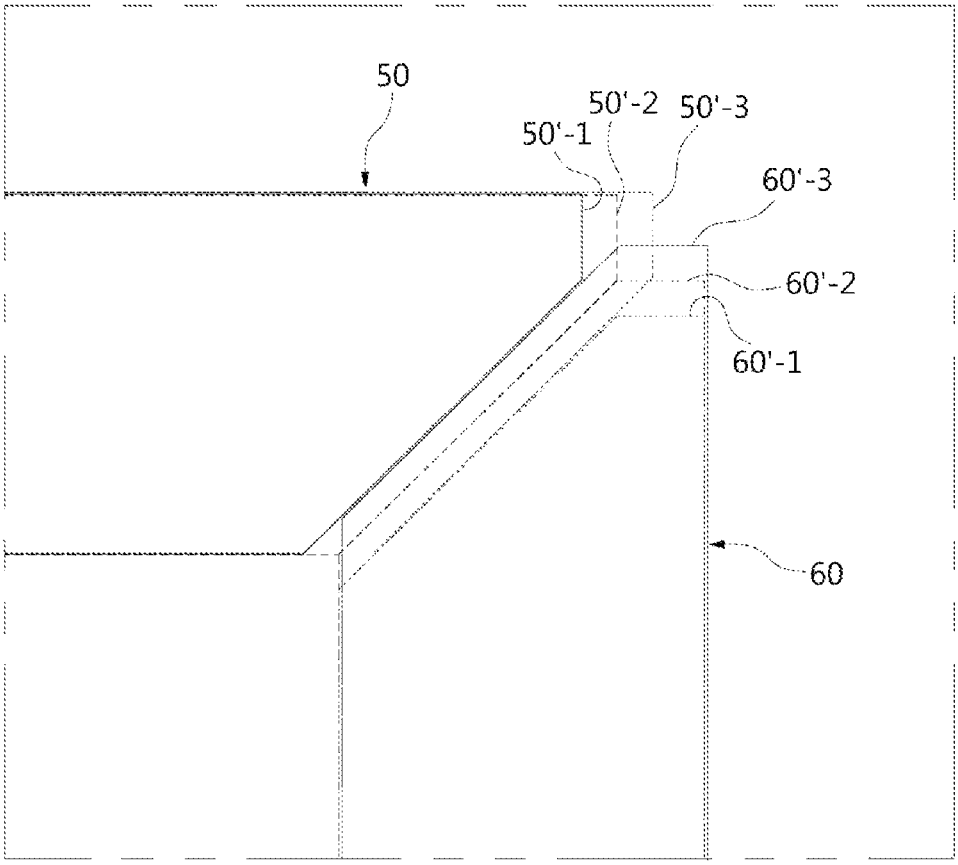
FIG. 7 is an exploded perspective view showing the state in which three pairs of yoke steel sheets and leg steel sheets are stacked in the same manner as shown in FIG. 6.

FIGS. 6 and 7 illustrate that the leg coupling portion 52 of each of the yokes 50 and 51 and the yoke coupling portion 62 of the end leg 60 are coupled to each other. Here, a coupled state using only three pairs of yoke steel sheets 50' and leg steel sheets 60' is shown. In actuality, this structure is periodically repeated in order to manufacture an iron core.

For the convenience of description, the three yoke steel sheets 50' will be referred to as a first yoke steel sheet 50'-1, a second yoke steel sheet 50'-2, and a third yoke steel sheet 50'-3. In addition, the three leg steel sheets 60' will be referred to as a first leg steel sheet 60'-1, a second leg steel sheet 60'-2, and a third leg steel sheet 60'-3.

As shown in FIG. 6, the first yoke steel sheet 50'-1 and the first leg steel sheet 60'-1 are in contact with each other at the first unit coupling end 54' and the second unit coupling end 64', and are stacked at the same height. For reference, the first unit coupling end 54' and the second unit coupling end 64' do not entirely coincide with each other but slightly deviate from each other, whereby non-contact portions are formed at one-side end of the first unit coupling end 54' and at the other-side end of the second unit coupling end 64'.

Subsequently, the second yoke steel sheet 50'-2 and the second leg steel sheet 60'-2 are in contact with each other such that the first unit coupling end 54' and the second unit coupling end 64' entirely coincide with each other, and are located on the first yoke steel sheet 50'-1 and the first leg steel sheet 60'-1, respectively. Here, the first yoke steel sheet 50'-1 and the second yoke steel sheet 50'-2 generally have the same width. In the case in which the first yoke steel sheet and the second yoke steel sheet have different widths (in the case in which the width of the yoke steel sheets 50' gradually increases or gradually decreases), it is necessary to align the centers of the first yoke steel sheet and the second yoke steel sheet with each other in the widthwise direction thereof. In general, several tens or several hundreds of yoke steel sheets 50' having the same width are stacked, and then yoke steel sheets 50' having decreased or increased widths are stacked.

When the second yoke steel sheet 50'-2 and the second leg steel sheet 60'-2 are stacked on the first yoke steel sheet 50'-1 and the first leg steel sheet 60'-1, respectively, the first unit coupling end 54' of the second yoke steel sheet 50'-2 protrudes further than the first unit coupling end 54' of the first yoke steel sheet 50'-1, and overlaps a corresponding end of the first leg steel sheet 60'-1.

Subsequently, the third yoke steel sheet 50'-3 and the third leg steel sheet 60'-3 are stacked on the second yoke steel sheet 50'-2 and the second leg steel sheet 60'-2, respectively. At this time, the first unit coupling end 54' of the third yoke steel sheet 50'-3 protrudes further than the first unit coupling end 54' of the second yoke steel sheet 50'-2. As a result, the first unit coupling end 54' of the third yoke steel sheet 50'-3 partially overlaps the second leg steel sheet 60'-2 via the second unit coupling end 64' of the second leg steel sheet 60'-2. At this time, it is necessary to align the central extension line of the third yoke steel sheet 50'-3 with the central extension lines of the first yoke steel sheet 50'-1 and the second yoke steel sheet 50'-2 in the longitudinal direction thereof. Of course, in the case in which the yoke steel sheets 50'-1, 50'-2, and 50'-3 have the same width, the yoke steel sheets sequentially extend so as not to protrude at the widths of the opposite ends thereof such that the yoke steel sheets overlap each other.

Meanwhile, the three yoke steel sheets 50' and the leg steel sheets 60' may be periodically repeatedly stacked in the manner shown in FIG. 6. Alternatively, in the case in which the stacking shown in FIG. 6 is expressed as forward stacking, forward stacking and reverse stacking may be repeatedly performed.

Figure 8:
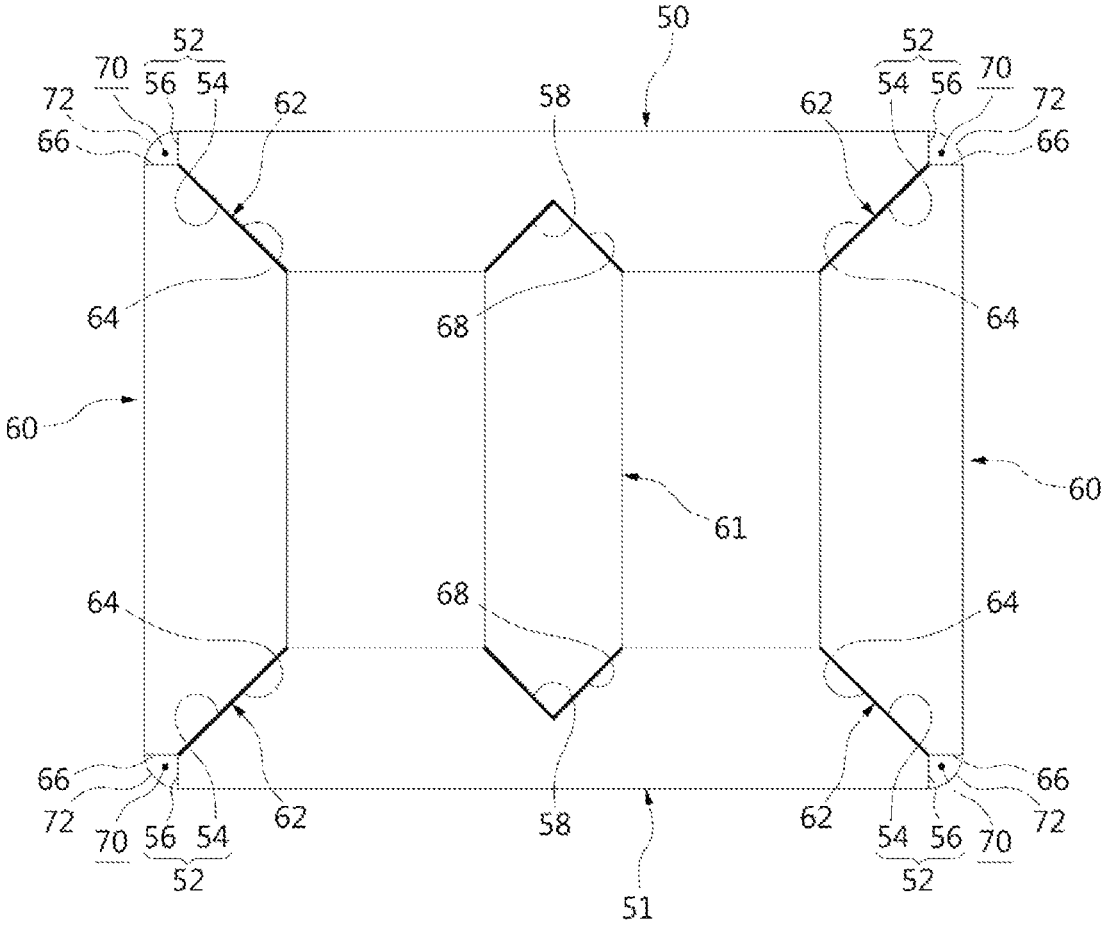
FIG. 8 is a front view showing the construction of another embodiment of the present invention.

FIG. 8 shows another embodiment of the present invention. Here, a space 70 is formed between the first open end 56 and the second open end 66 outside the portions at which the opposite ends of the yoke 50 and the opposite ends of the end leg 60 are connected to each other, and the space 70 is filled with a coupling material 72. In the case in which the cross-sectional shape of the yoke 50 or the end leg 60 is circular or approximately circular, the space 70 is circular. In the case in which the cross-sectional shape of the yoke 50 or the end leg 60 is quadrangular, the space is linear.

The coupling material 72 prevents the displacement of protruding open ends, among the respective first unit open ends 56' constituting the first open ends 56 and the respective second unit open ends 66' constituting the second open ends 66. That is, the space 70 may be filled with a material that functions as a kind of adhesive, as the coupling material 72, in order to fix the unit open ends 56' and 66'.

Hereinafter, the use of the iron core of the transformer according to the present invention having the above construction will be described in detail.

Figure 3:
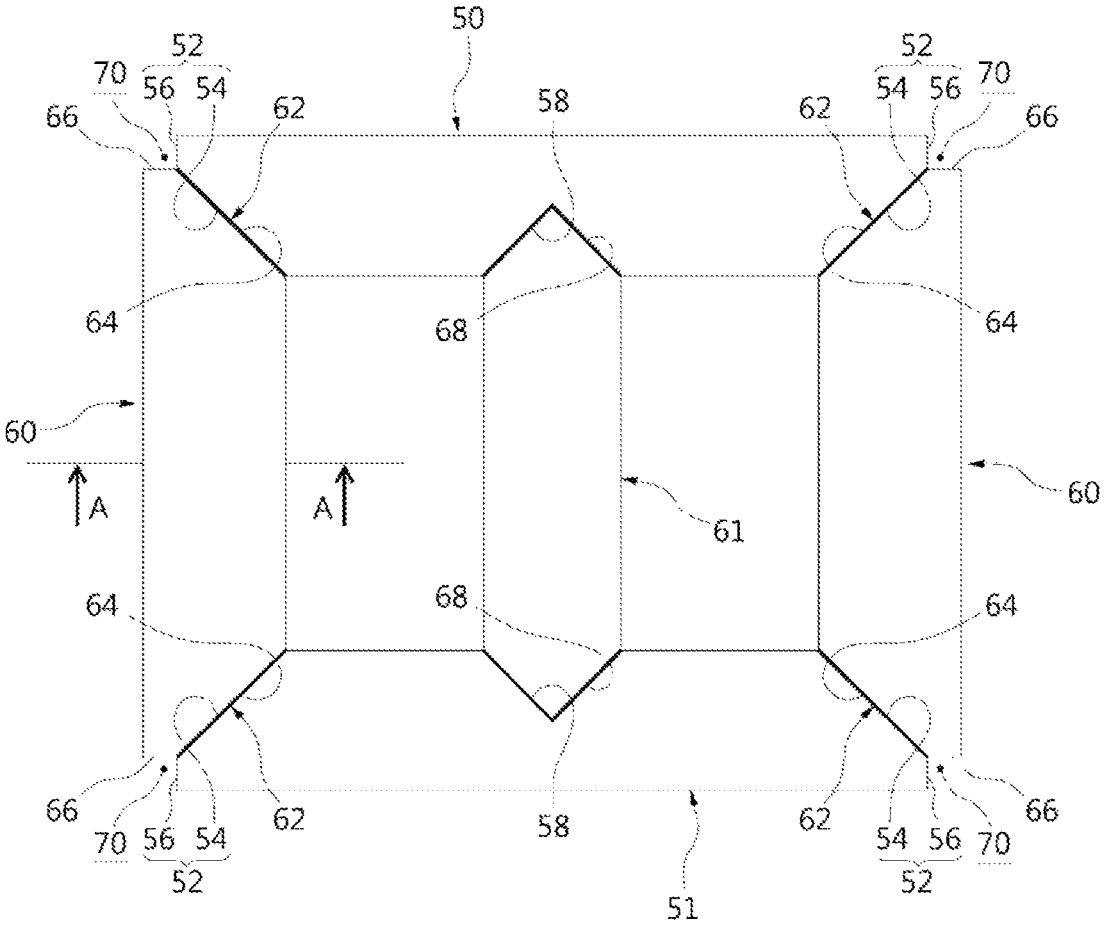
FIG. 3 is a front view showing the construction of a preferred embodiment of an iron core of a transformer according to the present invention.

At the time of manufacture of the transformer, winding wires are mounted on the legs 60 and 61 of the iron core according to the present invention shown in FIG. 3. Electric power supplied to one of the winding wires changes the magnitudes of alternating-current voltage and current using an electromagnetic induction phenomenon. The electric power thus changed is transmitted to the other winding wire and is then output.

In the above process, displacement may occur at the yoke steel sheets 50' or the leg steel sheets 60' constituting the iron core due to a magnetostriction phenomenon. In the present invention, however, the yoke steel sheets 50' and the leg steel sheets 60' are stacked such that opposite ends of the yoke steel sheets in the longitudinal direction thereof and opposite ends of the leg steel sheets in the longitudinal direction thereof overlap each other, whereby it is possible to minimize displacement.

Also, in the present invention, the first unit coupling end 54' and the first unit open end 56' are formed at each of the unit leg coupling portions 52', which are formed at opposite ends of each of the yoke steel sheets 50', and the second unit coupling end 64' and the second unit open end 66' are formed at each of the unit yoke coupling portions 62', which are formed at opposite ends of each of the leg steel sheets 60'.

Here, the stacked ones of the unit coupling ends 54' and 65' overlap each other by a predetermined amount, and the unit open ends 56' and 66' are not joined to each other, whereby a predetermined space 70 is formed. In this construction, the coupling between the yokes 50 and 51 and the end legs 60 is secure due to repeated overlapping between the yokes 50 and 51 and the end legs 60 at the leg coupling portions 52 of the yokes and the yoke coupling portions 62 of the end legs, and a predetermined space 70 is formed between the open ends 56 and 66. The space 70 formed between the open ends 56 and 66 prevents the unit open ends 56' and 66' from protruding out of the iron core. As a result, it is possible to prevent the occurrence of a magnetostriction phenomenon at some of the open ends 56 and 66 that protrude into the space 70. Consequently, it is possible to prevent the generation of vibration from the above portions.

Meanwhile, the space formed by the open ends 56 and 66 does not protrude out of the iron core but is formed in a channel shape. When the coupling material 72 is injected into the space 70 such that the space 70 is filled with the coupling material, therefore, it is possible to reinforce each outer corner of the iron core by the coupling material 72 in the state of not protruding out of the iron core.

Consequently, the first unit open ends 56' and the second unit open ends 66' of the unit leg coupling portions 52' and the unit yoke coupling portions 62' are fixed by the coupling material 72, whereby the generation of vibration is minimized.

The above description has been made merely to illustrate the technical idea of the present invention, and those skilled in the art to which the present invention pertains will appreciate that various variations and modifications are possible without departing from the intrinsic features of the present invention. Therefore, the embodiments disclosed in this specification are provided to describe the technical idea of the present invention, rather than to limit the technical idea of the present invention, and the scope of the present invention is not limited by the embodiments. The scope of protection of the present invention should be determined by the appended claims, and all technical ideas within the range equivalent to the appended claims should be understood to fall within the scope of rights of the present invention.

In the embodiment shown, the middle leg 61 is further provided, in addition to the end legs 60. Alternatively, no middle leg 61 may be provided, or a larger number of middle legs may be provided.

The invention claimed is:

1. An iron core of a transformer, the iron core comprising:

an upper yoke provided at opposite ends thereof with leg coupling portions, the upper yoke including a plurality of stacked yoke steel sheets;

a lower yoke extending parallel to the upper yoke, the lower yoke being provided at opposite ends thereof with leg coupling portions, the lower yoke including a plurality of stacked yoke steel sheets;

end legs including yoke coupling portions and installed in a direction perpendicular to a direction in which the upper yoke and the lower yoke extend, one end of each of the end legs being coupled to a corresponding one of the leg coupling portions of the upper yoke and the other end of each of the end legs being coupled to a corresponding one of the leg coupling portions of the lower yoke, wherein the plurality of stacked yoke steel sheets of the upper yoke and the lower yoke and leg steel sheets overlap each other by a predetermined length at a first coupling end of each of the leg coupling portions and a second coupling end of a corresponding one of the yoke coupling portions, and a space is formed between a first open end provided at each of the leg coupling portions and a second open end provided at a corresponding one of the yoke coupling portions, wherein each of the plurality of stacked yoke steel sheets of the upper yoke and the lower yoke is provided at opposite ends thereof with first unit coupling ends, each of which intersects, at an angle "a", a direction in which an outer side of each of the plurality of yoke steel sheets extends, the angle "a" being an acute angle, and an angle defined between an extension line of each of first unit open ends and the outer side of each of the plurality of yoke steel sheets is greater than the angle "a" and less than 180 degrees.

2. The iron core according to claim 1, wherein each of the leg steel sheets is provided at opposite ends thereof with second unit coupling ends, each of which intersects, at an angle "b", a direction in which an outer side of each of the leg steel sheets extends, the angle "b" being an acute angle, and an angle defined between an extension line of each of the second unit open ends and the outer side of each of the leg steel sheets is greater than the angle "b" and less than 180 degrees.

3. The iron core according to claim 1, wherein the yoke steel sheets and the leg steel sheets are stacked such that center lines of the yoke steel sheets and the leg steel sheets in a longitudinal direction thereof are aligned with each other, and are configured such that dimensions of the yoke steel sheets and the leg steel sheets in the longitudinal direction thereof are periodically changed.

4. The iron core according to claim 1, wherein the space formed between the first open end, provided at each of the leg coupling portions, and the second open end, provided at a corresponding one of the yoke coupling portions, is filled with a coupling material.

5. The iron core according to claim 1, wherein widths of the yoke steel sheets and the leg steel sheets are changed depending on positions at which the yoke steel sheets and the leg steel sheets are stacked such that at least a portion of each of the upper yoke, the lower yoke, and the end legs is curved.

6. The iron core according to claim 1, wherein the yoke steel sheets and the leg steel sheets periodically overlap each other by a predetermined length at the first coupling ends of the leg coupling portions and the second coupling ends of the yoke coupling portions.

* * * * *